US010472824B2

(12) United States Patent
Barry

(10) Patent No.: US 10,472,824 B2
(45) Date of Patent: Nov. 12, 2019

(54) LAMINATED STRUCTURAL ARCH SYSTEM

(71) Applicant: Timothy Brian Barry, New York, NY (US)

(72) Inventor: Timothy Brian Barry, New York, NY (US)

(73) Assignee: Timothy Brian Barry, New York, NY (US)

( * ) Notice: Subject to any disclaimer, the term of this patent is extended or adjusted under 35 U.S.C. 154(b) by 0 days.

(21) Appl. No.: 16/116,228

(22) Filed: Aug. 29, 2018

(65) Prior Publication Data

US 2019/0119914 A1 Apr. 25, 2019

Related U.S. Application Data

(60) Provisional application No. 62/591,468, filed on Nov. 28, 2017.

(51) Int. Cl.

| | |
|---|---|
| ***E04B 9/06*** | (2006.01) |
| ***E04B 7/08*** | (2006.01) |
| ***E04C 2/24*** | (2006.01) |
| ***E04C 2/08*** | (2006.01) |
| ***E04C 3/38*** | (2006.01) |

(52) U.S. Cl.

CPC ..... *E04B 9/061* (2013.01); *E04B 7/08* (2013.01); *E04C 2/08* (2013.01); *E04C 2/24* (2013.01); *E04C 3/38* (2013.01)

(58) Field of Classification Search

CPC ..... E04C 2/08; E04C 2/24; E04C 3/38; E04C 3/40; E04C 3/42; E04B 9/061; E04B 7/08; E04B 5/46; E04B 5/12; E04B 5/10

USPC ..... 52/88

See application file for complete search history.

(56) References Cited

U.S. PATENT DOCUMENTS

| | | | | | |
|---|---|---|---|---|---|
| 818,386 | A | * | 4/1906 | Luten | E04B 7/08 138/158 |
| 1,843,318 | A | * | 2/1932 | Frease | E04C 3/06 52/690 |
| 1,983,874 | A | * | 12/1934 | Pratt | E04C 3/292 38/137 |
| 2,247,186 | A | * | 6/1941 | Chelazzi | E04B 1/3416 52/644 |
| 2,413,145 | A | * | 12/1946 | Kump, Jr. | E04C 3/42 52/90.1 |

(Continued)

FOREIGN PATENT DOCUMENTS

| | | | | | |
|---|---|---|---|---|---|
| GB | 654942 | A | * | 7/1951 | E04B 7/08 |
| GB | 692312 | A | * | 6/1953 | E04C 3/083 |
| GB | 2364333 | A | * | 1/2002 | E04B 1/24 |

*Primary Examiner* — Adriana Figueroa

(57) ABSTRACT

A laminated structural arch system for supporting a horizontal planar structure, comprising at least one laminated arch. Each laminated arch is comprised of a plurality of arch plates rigidly fastened together in parallel, and forming a laminated configuration. Each arch plate is separated from the arch plate adjacent to it by a separation gap. The laminated structural arch system may contain two or more laminated arches positioned in parallel and secured to an anchoring structure, allowing one or more panels which comprise the horizontal planar structure to be positioned across and supported by the laminated arches. The laminated structural arch system may be provided as a kit of disassembled arch plates, allowing the system to be easily transported, handled, and assembled.

4 Claims, 9 Drawing Sheets

(56) References Cited

U.S. PATENT DOCUMENTS

| | | | | | |
|---|---|---|---|---|---|
| 2,688,167 | A * | 9/1954 | Wilson | E04C 3/40 | 403/402 |
| 2,836,859 | A * | 6/1958 | Crissey | E04B 9/00 | 52/22 |
| 3,039,152 | A * | 6/1962 | Hillesheim | E04C 3/42 | 52/642 |
| 4,083,153 | A * | 4/1978 | Sumpter | E04B 9/00 | 52/22 |
| 4,655,021 | A * | 4/1987 | Franchin | E04B 1/19 | 52/641 |
| 9,322,158 | B1 * | 4/2016 | Langmeier | E04C 3/36 | |

* cited by examiner

LAMINATED STRUCTURAL ARCH SYSTEM

TECHNICAL FIELD

The present disclosure relates generally to a system employing a structural arch as a structural member. More particularly, the present disclosure relates to a system for supporting a horizontal planar structure, employing at least one laminated arch comprised of a plurality of arch plates rigidly fastened together in a laminated configuration for strength and lightness.

BACKGROUND

The arch is a structure which has been employed in architecture and engineering for thousands of years. Arches are commonly used to support roofs and ceilings in buildings. Structural arches are typically made of steel, and are often heavy and costly to install. It is necessary to employ heavy machinery, such as a crane, to lift conventional arches to the required height in order to construct roofs and ceilings. The transportation of conventional arches to the construction site and the subsequent unloading and handling often entails great expenditures of time and labor as the arches must be hauled in using multiple trucks and unloaded using machinery.

Furthermore, conventional steel arches are often thick, and obscure the light passing through them.

There is therefore, a need for a structural arch system which is adaptable and suitable for a variety of applications while providing similar load bearing strength as a traditional arch, at a significant reduction in expense and labor compared with construction using conventional arched structural members.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a laminated structural arch system which can be installed within a building or structure to support a load. Accordingly, the present disclosure provides a laminated structural arch system comprising at least one laminated arch. Each laminated arch has a laminated arch arcuate edge which is substantially arch shaped and supports a laminated arch supporting surface. Each laminated arch may be secured to an anchoring structure via a pair of laminated arch anchoring points distally disposed on opposite ends of the laminated arch arcuate edge. Two or more laminated arches may be secured to the anchoring structure in a parallel arrangement, allowing a load to be positioned across and be supported by the laminated arch supporting surface of each laminated arch.

It is another aspect of an example embodiment in the present disclosure to provide a laminated structural arch system where each laminated structural arch retains the supporting strength of a traditional solid arch, but has a fraction of the weight of the traditional solid arch. Accordingly, each laminated arch is comprised of a plurality of arch plates rigidly fastened together in parallel to form a laminated configuration where a separation gap separates each arch plate from the arch plate adjacent to it. Furthermore, the depth of each laminated arch may be increased or reduced by varying the thickness of each arch plate and/or the width of the separation gaps.

It is yet another aspect of an example embodiment in the present disclosure to provide a laminated structural arch system which supports a horizontal planar structure such as a ceiling, roof, or walkway. Accordingly, the horizontal planar structure may comprise one or more panels positioned across the laminated arch supporting surfaces of each laminated arch. It is a further aspect of an example embodiment in the present disclosure to provide a laminated structural arch system which can be easily transported, handled, and assembled. Accordingly, the laminated structural arch system can be transported to an installation site as a kit of disassembled arch plates. Each arch plate may further be divided in half to facilitate ease of handling and assembly. The plurality of arch plates may then be assembled by workers at the installation site without reliance on heavy machinery.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
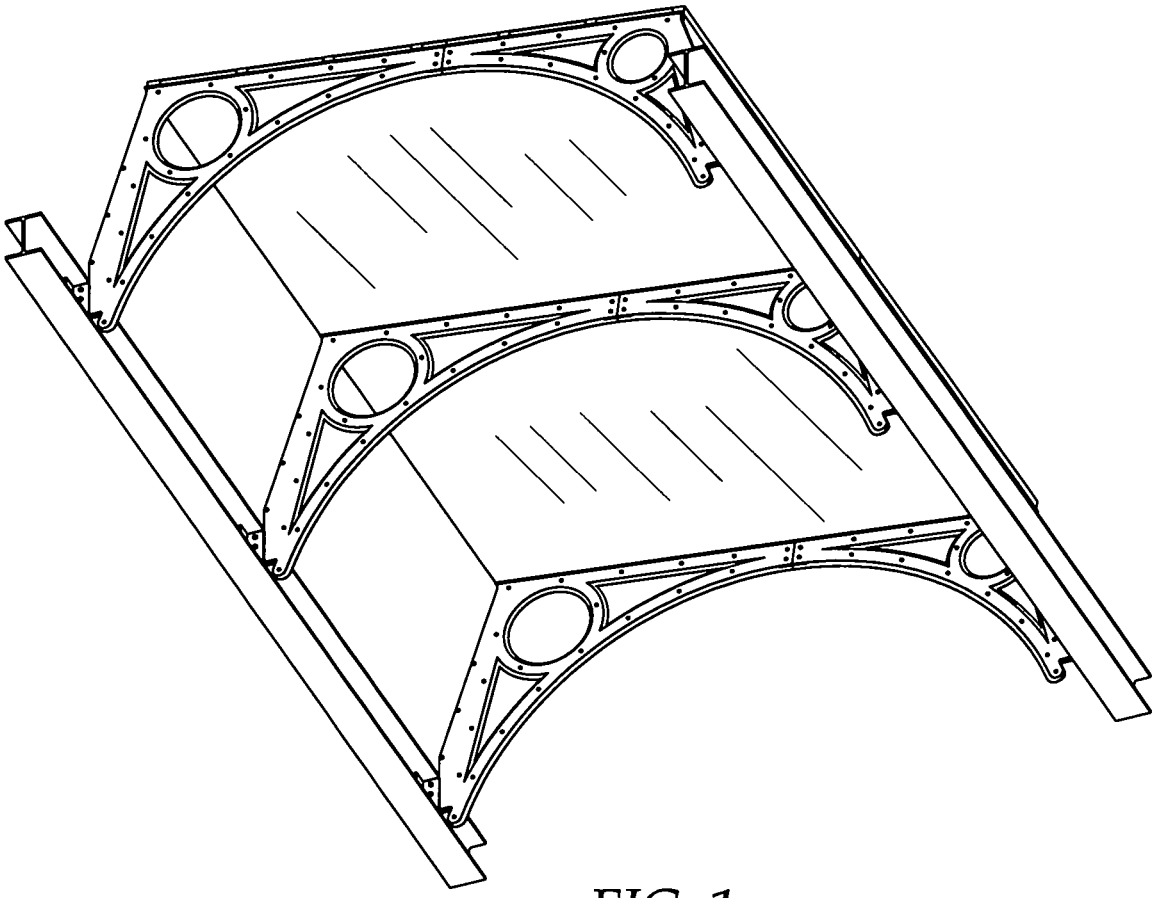
FIG. 1A is a diagrammatical perspective view of a laminated structural arch system anchored between two beams, in accordance with an embodiment of the present disclosure.
FIG. 1B is an orthographic front view of the laminated structural arch system, in accordance with an embodiment of the present disclosure.
Figure 1A:
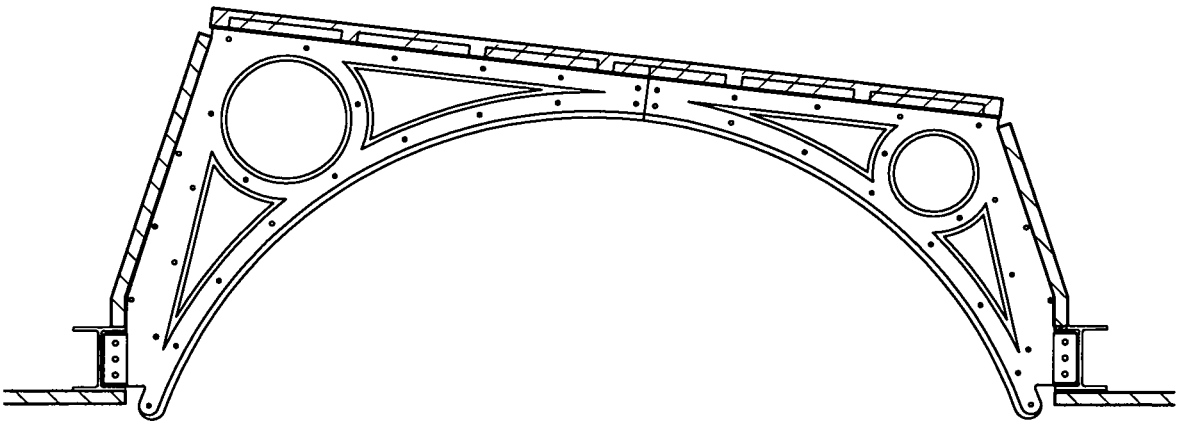

FIGS. 1A and 1B illustrate a laminated structural arch system 10 comprising at least one laminated arch 20 capable of functioning as a structural member within a building or other structure. Each laminated arch 20 comprises a plurality of arch plates placed in a parallel configuration, with a separation gap between each arch plate and the arch plate adjacent to it. The plurality of arch plates are fastened together in a rigid laminated configuration, allowing each laminated arch to retain the strength of a traditional solid arch but have only a fraction of the weight of the solid arch. Each arch plate is preferably made from steel, although alternative materials commonly employed for use in structural members can be used in place of steel, as will be apparent to a person of ordinary skill in the art in the field of the invention. Furthermore, the laminated structural arch system 10 can be provided as a kit of disassembled arch plates, allowing the system to be transported, handled, and assembled at the site where the system is to be installed, without the large expenditure of labor and resources normally associated with the transportation and handling of large structural members.

Each laminated arch 20 has a substantially arch-shaped laminated arch arcuate edge 26 with two opposite ends 26A, 26B. The laminated arch arcuate edge 26 supports a laminated arch supporting surface 22, allowing each laminated arch 20 to support a load exerting a downwards force upon the laminated arch 20. Each laminated arch 20 further has a pair of laminated arch anchoring points, comprising a laminated arch first anchoring point 30A and a laminated arch second anchoring point 30B distally positioned at the opposite ends of the laminated arch arcuate edge 26. The laminated arch first and second anchoring points 30A, 30B anchor the laminated arch 20 to an anchoring structure. In a preferred embodiment, the anchoring structure can be a pair of parallel structural beams comprising a first beam 120A and a second beam 120B. The laminated arch first and second anchoring points 30A, 30B may each be attached to a first anchoring plate 40A and a second anchoring plate 40B respectively. Each laminated arch 20 may be anchored by securing the first and second anchoring plates 40A, 40B to the first and second beams 120A, 120B using bolts, welding, or other means.

Each laminated arch 20 may also have a pair of laminated arch abutment surfaces, comprising a laminated arch first and second abutment surface 24A, 24B. The laminated arch first and second abutment surfaces 24A, 24B may extend vertically between the laminated arch supporting surface 22 and the laminated arch first and second anchoring points 30A, 30B respectively. The laminated arch first and second abutment surfaces 24A, 24B may be used to secure the laminated arch 20 between two parallel and opposing surfaces, such as a pair of opposing walls. The laminated arch first and second abutment surfaces 24A, 24B may also be used to support one or more vertical panels 126. Each laminated arch 20 may further have one or more cutouts 130 passing through the laminated arch 20 for the purpose of reducing the weight, or for aesthetic effect.

The laminated structural arch system 10 may be employed to support a substantially horizontal planar structure such as a ceiling, roof, walkway, or other structure as will be apparent to a person of ordinary skill in the art in the field of the invention. The horizontal planar structure may comprise one or more panels 124. In a preferred embodiment, the panels 124 may be rectangular, and have a pair of lateral sides and a pair of longitudinal sides. Two or more of the laminated arches 20 may be positioned parallel to each other and then secured to the anchoring structure 118, allowing the supporting surface 22 of each laminated arch 20 to support the one or more panels 124. In some embodiments, each laminated arch 20 may be either symmetrical, or asymmetrical. For example, an asymmetrical arch may have a second abutment surface which is shorter than the first abutment surface, allowing the horizontal planar structure to have a sloped configuration.

In a preferred embodiment, each laminated arch 20 may further comprise a supporting plate 80 which rests on the supporting surface 22 of the laminated arch 20. The supporting plate 80 covers substantially the entire supporting surface 22, and the panels 124 may rest directly on top of the supporting plate 80 instead of the supporting surface 22. Each laminated arch 20 may further have a plurality of seam projections 84 which project upwards from the laminated arch supporting surface 22. The supporting plate 80 may have a plurality of retention slots 82 which align with and allow the seam projections 84 to pass through the supporting plate 80. Each panel 124 may be positioned between two adjacent laminated arches 20, so that the longitudinal edges of the panel abut against the seam projections 84 of the two adjacent laminated arches 20. The seam projections 84 may have a height which does not exceed the thickness of each panel 124.

Figure 2:
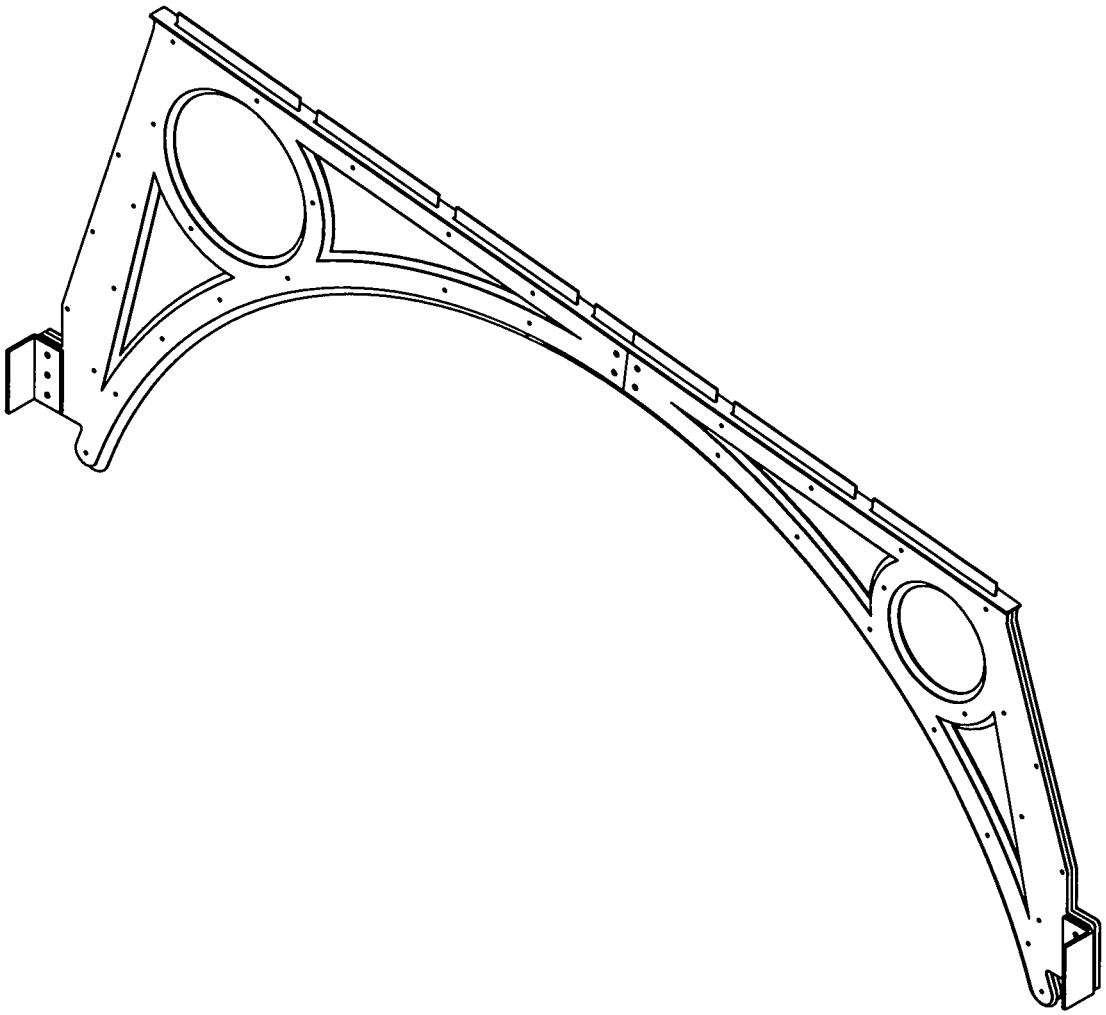
FIG. 2 is an exploded perspective view of a laminated arch, revealing a plurality of arch plates joined in a laminated configuration to form the laminated arch, in accordance with an embodiment of the present disclosure.
Figure 3:
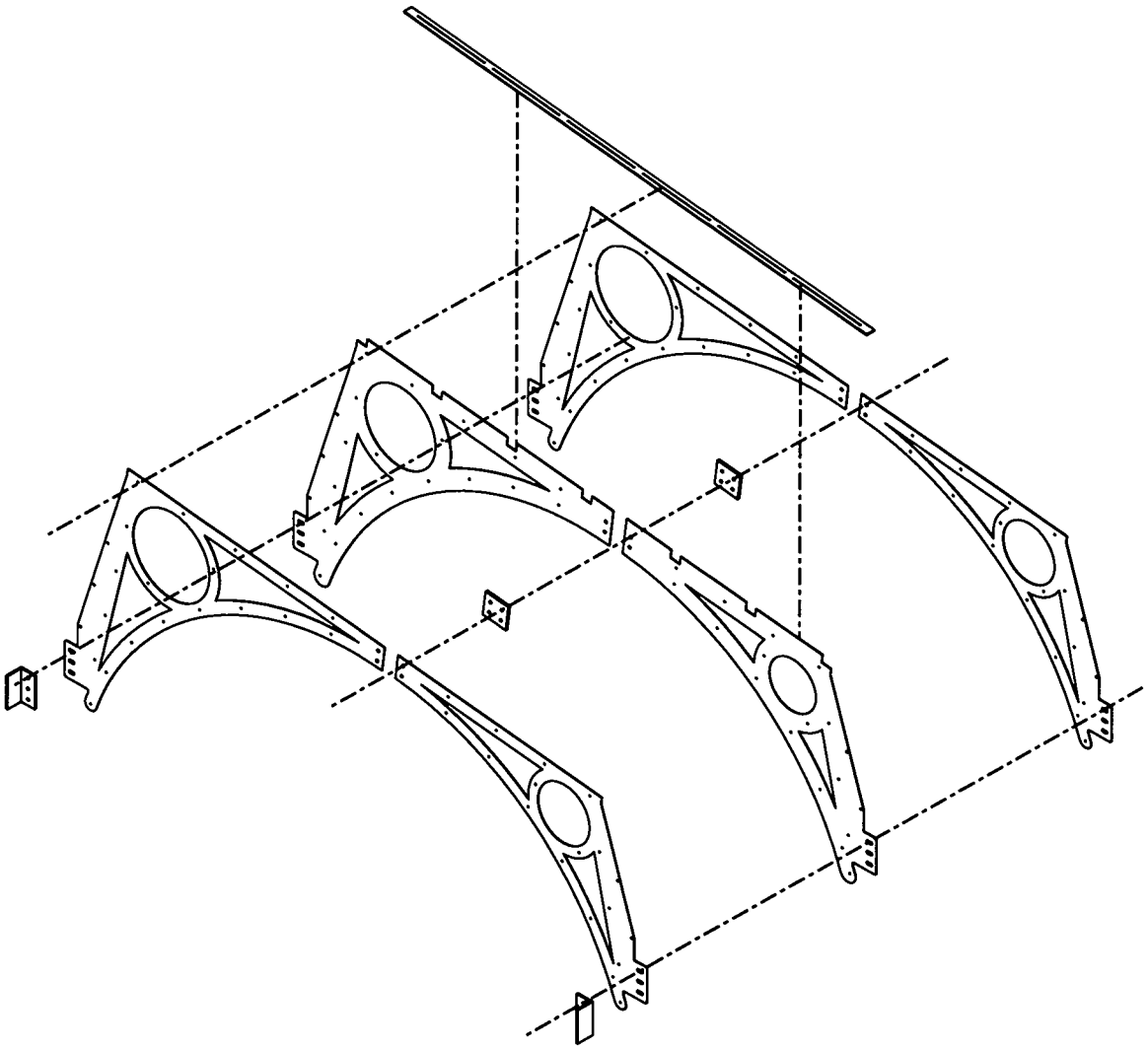
FIG. 3 is a diagrammatical perspective view of the assembled laminated arch, in accordance with an embodiment of the present disclosure.

Turning now to FIGS. 2-3, while continuing to refer to FIGS. 1A-B, the plurality of arch plates forming each laminated arch 20 may comprise an inner arch plate 44 positioned between a first outer arch plate 54 and a second outer arch plate 64. Each arch plate may share substantially the same shape as the laminated arch 20. In a preferred embodiment, the inner arch plate 44 may have an inner arch plate arcuate edge 51, an inner arch plate supporting edge 48, an inner arch plate first abutment edge 50A and an inner arch plate second abutment edge 50B. The first outer arch plate 54 may have a first outer arch plate arcuate edge 61, a first outer arch plate supporting edge 58, a first outer arch plate first abutment edge 60A and a first outer arch plate second abutment edge 60B. The second outer arch plate 64 may have a second outer arch plate arcuate edge 71, a second outer arch plate supporting edge 68, a second outer arch plate first abutment edge 70A and a second outer arch plate second abutment edge 70B. The inner arch plate 44 may also have an inner arch plate first anchoring point 52A and an inner arch plate second anchoring point 52B. The first outer arch plate 54 may also have a first outer arch plate first anchoring point 62A and a first outer arch plate second anchoring point 62B. The second outer arch plate 64 may also have a second outer arch plate first anchoring point 72A and a second outer arch plate second anchoring point 72B. In a preferred embodiment, the inner arch supporting edge 48 and the first and second outer arch supporting edges 58, 68 are coplanar, and the supporting edges in combination form the laminated arch supporting surface 22. Furthermore, the plurality of seam projections 84 may project upwards from the inner arch supporting edge.

The inner arch plate 44 and the first and second outer arch plates 54, 64 may have a plurality of reinforcing holes 86 disposed across each arch plate. The plurality of reinforcing holes 86 of the inner arch plate 44 are coaxial with the plurality of reinforcing holes 86 of the first and second outer arch plates 54, 64, allowing the plurality of arch plates to be fastened together using a plurality of reinforcing bolts extending through the reinforcing holes 36 of the first outer arch plate 54, the inner arch plate 44, and the second outer arch plate 64, as shown by the reinforcing hole axis lines 86L depicted in FIG. 2. A plurality of reinforcing spacers, threaded coaxially with the reinforcing bolts and positioned between the arch plates, maintain the separation gap between each arch plate and the arch adjacent to it.

Each laminated arch 20 may be divided into a laminated arch first half 21A and a laminated arch second half 21B to further simplify the transportation and handling of the laminated structural arch system 10. The laminated arch first and second halves 21A, 21B may be divided at a connecting point 32 located approximately midway between the opposite ends 26A, 26B of the laminated arch arcuate edge 26. Each of the inner arch plate 44, first outer arch plate 54, and second outer deli plate 64 may each be divided into two separate halves. The inner arch plate 44 may comprise an inner arch plate first half 45A and inner arch plate second half 45B. The inner arch plate first and second halves 45A, 45B may join together at an inner arch plate first connecting edge 46A and an inner arch plate second connecting edge 46B to form the complete inner arch plate 44. The first outer arch plate 54 may comprise a first outer arch plate first half 55A and a first outer arch plate second half 55B, and the second outer arch plate 64 may comprise a second outer arch plate first half 65A and a second outer arch plate second half 65B. The first outer arch plate first and second halves 55A, 55B may join together at a first outer arch plate first connecting edge 56A and first outer arch plate second connecting edge 56B to form the complete first outer arch plate 54. The second outer arch plate first and second halves 65A, 65B may join together at a second outer arch plate first connecting edge 66A and second outer arch plate second connecting edge 66B to form the complete second outer arch plate 64.

In a preferred embodiment, the inner arch plate first connecting edge 46A, and the first and second outer arch plate first connecting edges 56A, 66A are fastened to the inner arch plate second connecting edge 46B, and the first and second outer arch plate second connecting edges 56B, 66B respectively, via a plurality of connecting plates 34 positioned at the connecting point 32. The connecting point 32 may have a plurality of connecting holes 36 formed on the connecting plates 34, the first outer arch plate 54, the inner arch plate 44, and the second outer arch plate 64. A plurality of connecting bolts pass through the plurality of connecting holes, such as along connecting hole axial line 36L shown in FIG. 2, to rigidly fasten together the halves of each arch plate.

The first and second anchoring plates 40A, 40B may be fastened to the laminated arch first and second anchoring points 30A, 30B using a plurality of anchoring plate bolts. The anchoring plate bolts pass through a plurality of anchoring plate fastening holes, such as along anchoring plate fastening hole axis line 92L, which are coaxially aligned and positioned on the first and second anchoring plates 40A, 40B, the inner arch plate first and second anchoring points 52A, 52B, the first outer arch plate first and second anchoring points 62A, 62B, and the second outer arch plate first and second anchoring points 72A, 72B.

The assembled laminated arch 20 as shown in FIG. 3, while also referring to FIG. 2, is rigidly fastened in a laminated configuration by the plurality of reinforcing bolts and the connecting plates 34, but retains a first separation gap between the inner arch plate 44 and the first outer arch plate 54, and a second separation gap between the inner arch plate 44 and the second outer arch plate 64.

Figure 4:
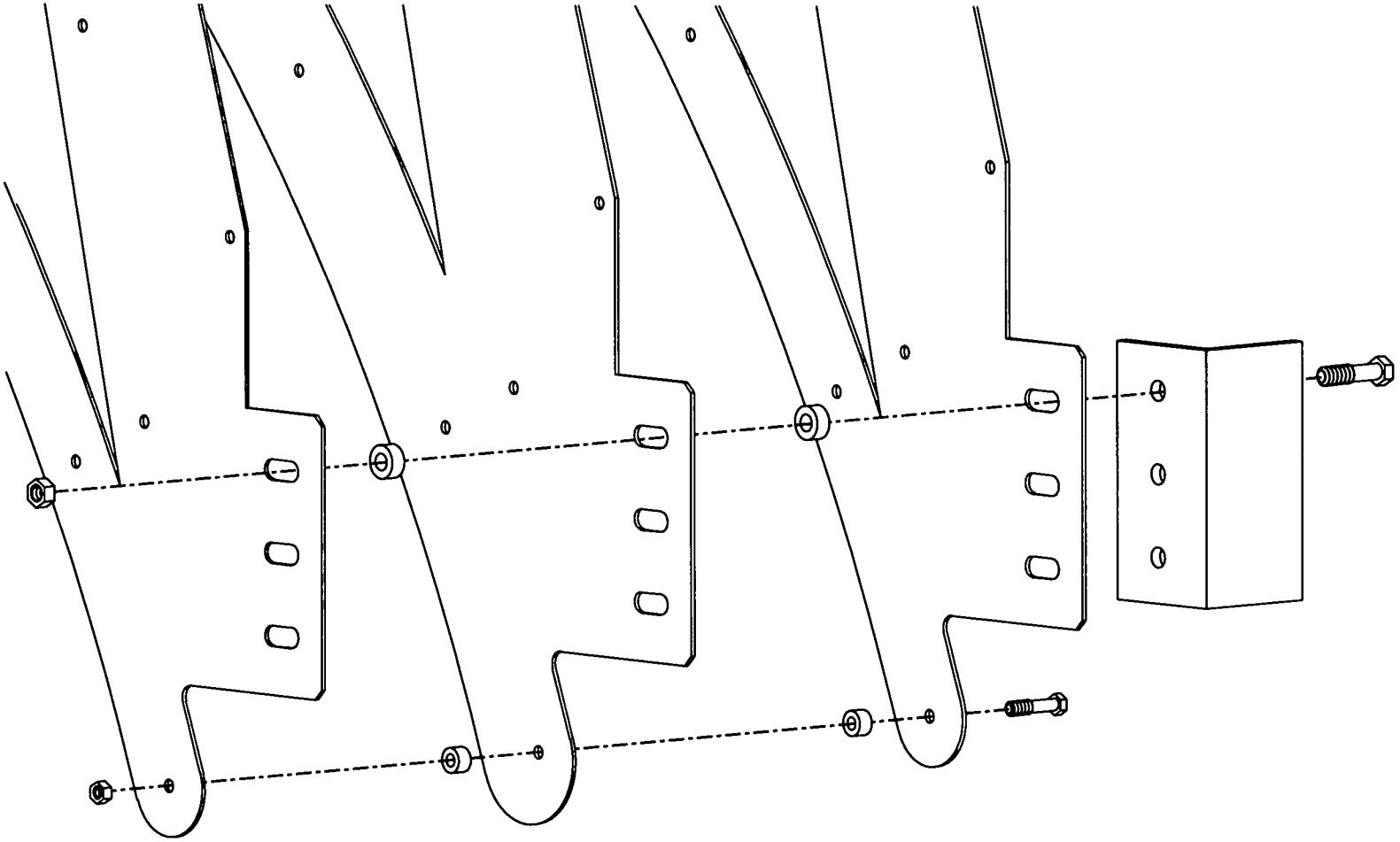
FIG. 4 is a vertical sectional view of a laminated arch within the laminated structural arch system, showing the arrangement of a reinforcing bolt and a plurality of reinforcing spacers, in accordance with an embodiment of the present disclosure.

Turning to FIG. 4, while continuing to refer to FIGS. 1A-B and FIGS. 2-3, the laminated configuration of the arch plates is shown in a vertical sectional view of the laminated arch 20. The inner arch plate 44 is positioned between the first outer arch plate 54 and the second outer arch plate 64. In a preferred embodiment, the inner arch plate 44 has an inner arch plate first surface 47A facing the first outer arch plate 54, and an inner arch plate second surface 47B facing the second outer arch plate 64. The first and second outer arch plates 54, 64 have a first outer arch plate inner surface 57A and second outer arch plate inner surface 67A respectively, each facing towards the inner arch plate 44. The first and second outer arch plates 54, 64 also have a first and second outer arch plate outer surface 57B, 67B respectively, facing away from the inner arch plate 44. The first separation gap 84A has a width corresponding to the distance between the inner arch plate first surface 47A and the first outer arch plate inner surface 57A, while the second separation gap 84B has a width corresponding to the distance between the inner arch plate second surface 47B and the second outer arch plate inner surface 67A. The reinforcing holes 86 of the plurality of arch plates are coaxial, allowing the reinforcing bolt 87 to pass through the reinforcing holes 86 to be secured by a reinforcing bolt nut 88. To further provide strength and rigidity to the laminated arch 20, one of the reinforcing spacers 90 may be positioned within each of the first separation gap 84A and the second separation gap 84B such that the reinforcing bolt 87 passes through the reinforcing spacers 90 before being secured in place by the reinforcing bolt 88. Each reinforcing spacer 90 has a length which is substantially the same as the width of the first and second separation gaps 84A, 84B, allowing the reinforcing spacers 90 to maintain the spacing between the arch plates to preserve the laminated configuration, and also ensuring that the plurality of arch plates are rigidly fastened together by the reinforcing bolts 87 distributed across each laminated arch 20.

Figure 5:
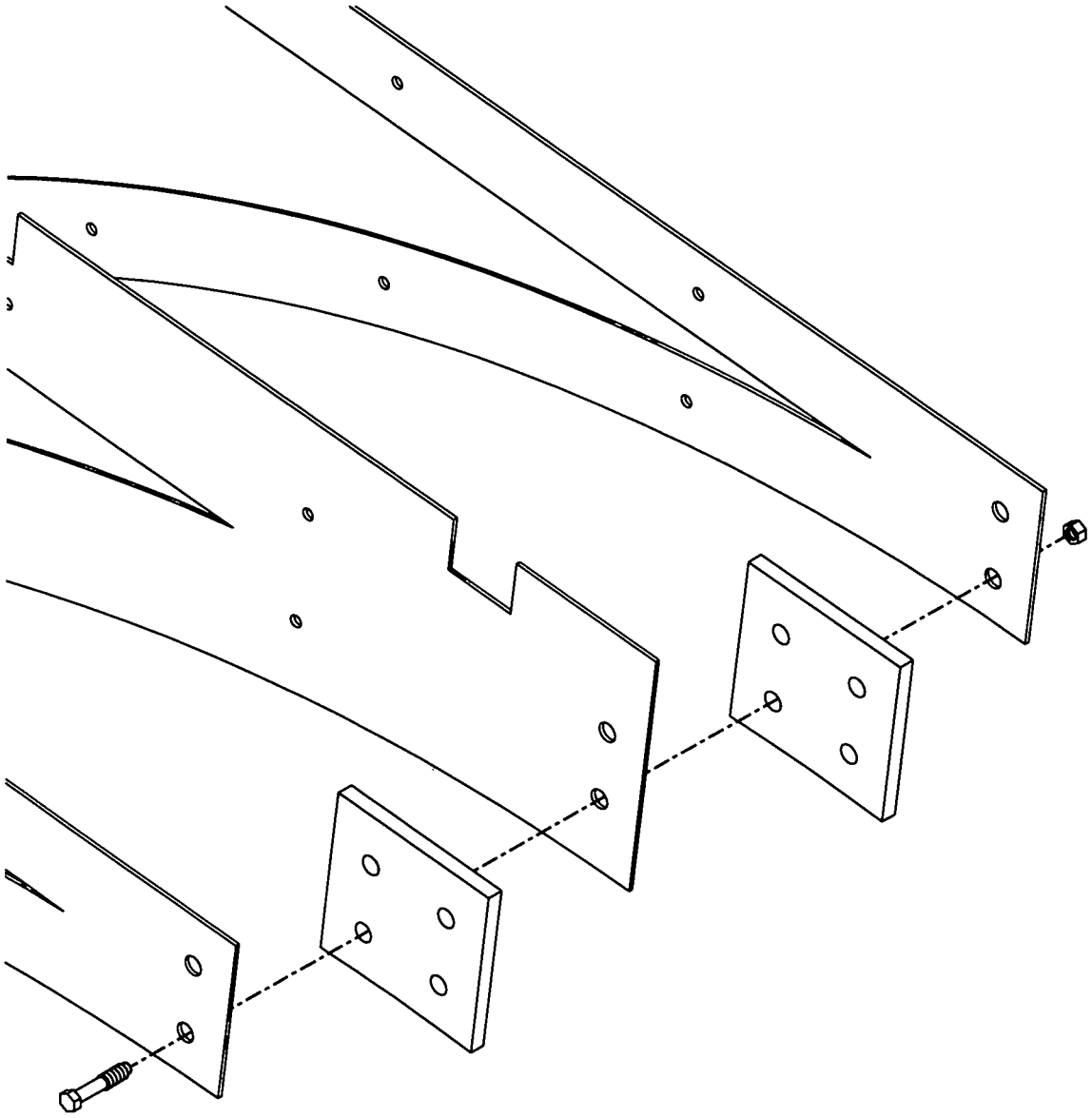
FIG. 5 is an exploded perspective view of the laminated arch, showing a plurality of connecting plates positioned between the arch plates, in accordance with an embodiment of the present disclosure.

Turning now to FIG. 5, while continuing to refer to FIGS. 1A-B and FIGS. 2-4, the connecting plates 34 are positioned between the various arch plates at the connecting point 32, with one connecting plate 34 positioned within each of the first and second separation gaps 84A, 84B. The connecting plates 34 serve a function similar to the reinforcing spacers 90. Each connecting plate 34 has a thickness which matches the width of the first and second separation gaps 84A, 84B. The plurality of connecting bolts 37 pass through the coaxial connecting holes 36 disposed on the connecting plates and the plurality of arch plates, and are secured and tightened using a plurality of connecting nuts 38. By tightening the connecting bolts 37 and connecting nuts 38, the first and second outer arch plates 54, 64 may be compressed inwards towards the inner arch plate 44. The connecting plates 34 ensure that the first and second separation gaps 84A, 84B are maintained, preserving the laminated configuration and allowing the laminated arch first and second halves 21A, 21B to be rigidly secured at the connecting point.

Figure 6:
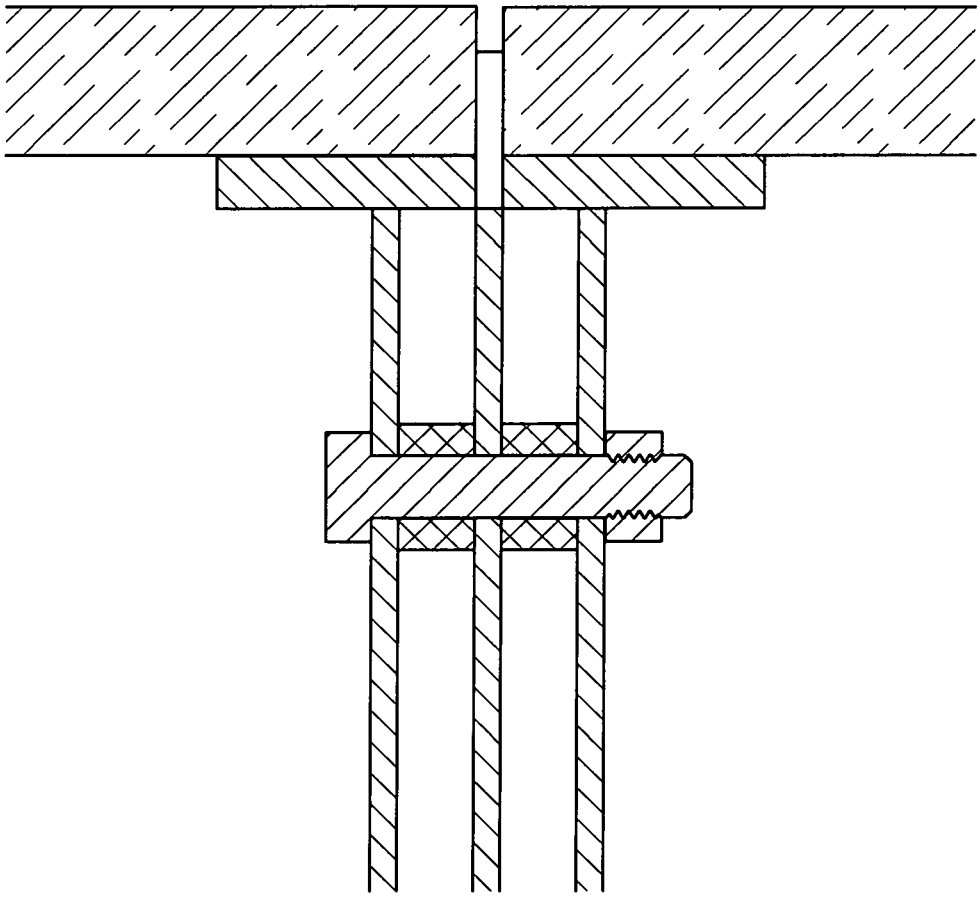
FIG. 6 is an exploded perspective view of a laminated arch anchoring point showing, in accordance with an embodiment of the present disclosure.

Turning now to FIG. 6, while also referring to FIGS. 1A-B and FIGS. 2-5, the first and second anchoring plates 40A, 40B may each be fashioned out of a single plate. The first anchoring plate 40A may comprise a first anchoring surface 42A disposed perpendicularly in relation to a first fastening surface 43A, while the second anchoring plate 40B may comprise a first anchoring surface 42A disposed perpendicularly in relation to a first fastening surface 43A. In a preferred embodiment, the first and second anchoring surfaces 42A, 42B may be secured to the first beam 120A and second beam 120B respectively. The first and second anchoring plates 40A, 40B are fastened to the laminated arch first and second anchoring points 30A, 30B by the plurality of anchoring plate bolts 94 passing through the anchoring plate fastening holes 92 coaxially aligned and disposed along the first and second fastening surfaces 43A, 43B, first and second outer arch plate anchoring points 62A, 62B, the inner arch plate first and second anchoring points 52A, 52B, and the second outer arch plate first and second anchoring points 72A, 72B. The anchoring plate bolts 94 may be tightened and secured using a plurality of anchoring plate nuts 95. Furthermore, a plurality of anchoring point spacers 96 may be positioned within the first and second separation gaps 84A, 84B such that the anchoring bolts pass through the anchoring point spacers 96 before being tightened by the anchoring plate nuts 95. The anchoring point spacers 96 have a width which is substantially the same as the width of the first and second separation gaps 84A, 84B, and function in substantially the same manner as the reinforcing spacers 90 by reinforcing the laminated arch 20 and preserving the laminated configuration at the laminated arch first and second anchoring points 30A, 30B.

Returning to FIG. 4, while also referring to FIGS. 1A-B, and FIGS. 2-3, each laminated arch 20 has a depth corresponding to the distance between the first outer arch plate outer surface 57B and the second outer arch plate outer surface 67B. The depth of each laminated arch 20 may be varied, by employing arch plates of different thicknesses, adjusting the width of the first and second separation gaps 84A, 84B, or a combination of the two. In one embodiment, the inner arch plate 44, first and second outer arch plates 54, 64 are each made of steel plate which is one-eighth of an inch in thickness. The first and second separation gaps 84A, 84B are each one half of an inch in width, resulting in a totally exemplary depth of one and three-eighths of an inch for the laminated arch 20. Increasing the depth of each laminated arch 20 has the benefit of increasing the area of the laminated arch supporting surface 22, and potentially increasing the strength of the laminated arch 20. In one embodiment, the depth of each laminated arch 20 may be six inches in total or more. It will be apparent to a person of ordinary skill in the art in the field of the invention to determine the appropriate thickness of the arch plates and the width of the separation gaps in light of the composition of the arch plates and the load the laminated structural arch system 10 is intended to support.

In some embodiments, the supporting plate 80 may have its width increased such that the width of the supporting plate 80 exceeds the depth of the laminated arch 20. The supporting plate 80 provides a stable platform on which the panels 124 may rest, allowing the depth of the laminated arch 20 to be reduced. Furthermore, the seam projections 84 ensure that the longitudinal edges of the panels 124 are horizontally supported within the laminated structural arch system 10. The separation between two adjacent panels 124 corresponds to a panel seam 128. The seam projections 84 may have a width which is substantially equal to the width of the panel seam 128, allowing the longitudinal edges of the panels 124 abut against the seam projections 84. The panel seam 128 may further be sealed with silicone caulk or another similar sealant.

By reducing the depth of each laminated arch 20, the laminated structural arch system 10 is well suited for supporting a horizontal planar structure such as a skylight or glass walkway, where the panels 124 are made of glass or other transparent material. By using laminated arches 20 with shallower depth, the laminated structural arch system 10 may expose a proportionally greater surface area of glass or transparent panels 124, allowing more light to pass through the system. The cutouts 130 may also serve to allow light to pass through the laminated arches 20.

Figure 7:
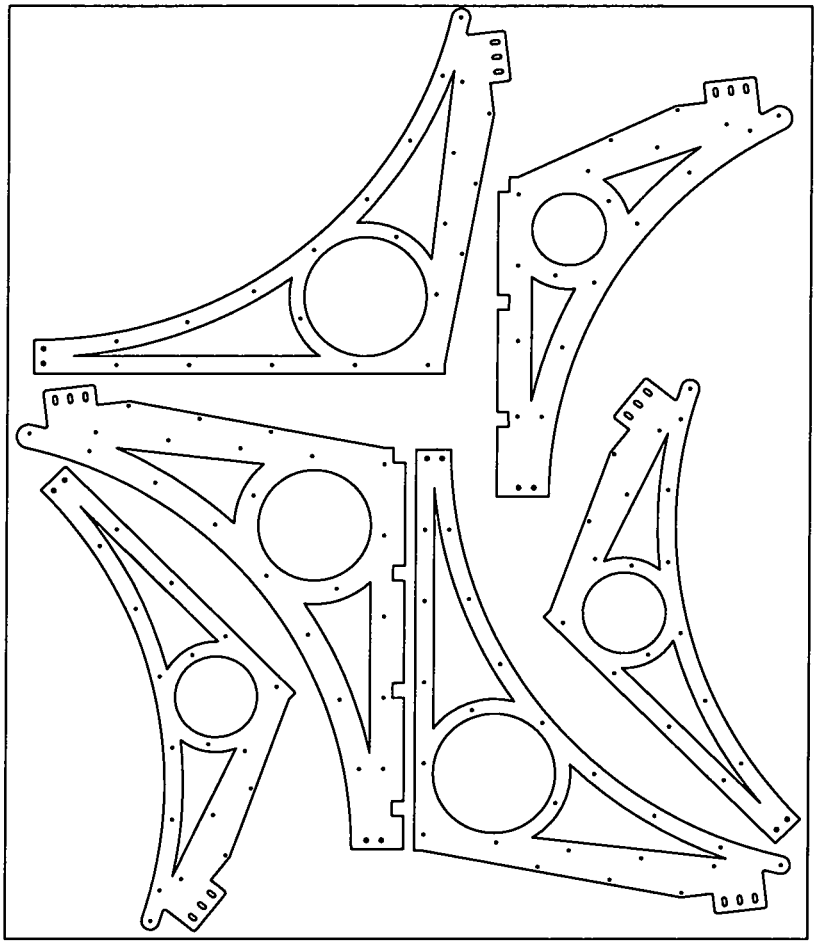
FIG. 7 is a diagrammatical top view of a kit containing a plurality of disassembled arch plates, in accordance with an embodiment of the present disclosure.

Turning now to FIG. 7 while simultaneously referring to FIGS. 1A, 2, 5, and 6, the laminated structural arch system 10 can be provided as a kit 130 of disassembled arch plates 140 along the assorted bolts, spacers, other components needed to assemble the system. The individual arch plates 140 may be stacked together to conserve space and to facilitate transportation and storage. In some embodiments, the entire kit 130 may be placed within a pickup truck for transportation to the site where the system is to be installed.

Figure 8A:
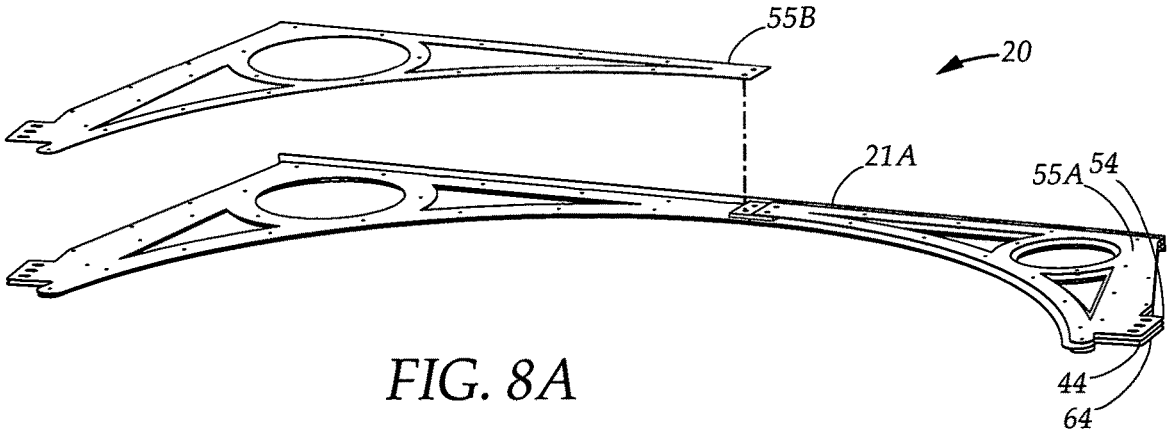
FIG. 8A is a diagrammatic perspective view of a laminated arch in the process of being assembled, in accordance with an embodiment of the present invention.
Figure 8B:
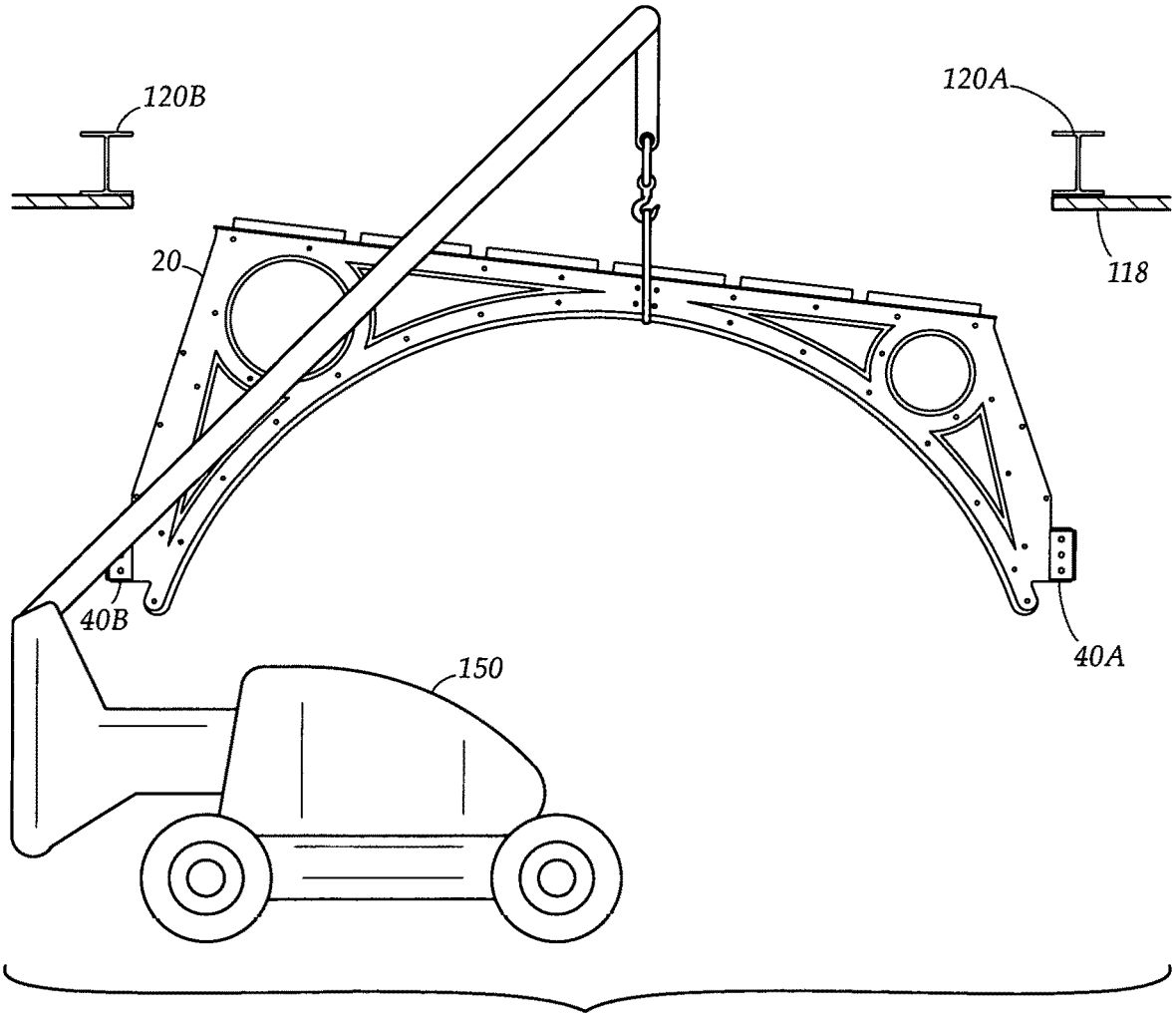
FIG. 8B is a diagrammatic side view of the laminated arch being raised using a hoist, in accordance with an embodiment of the present disclosure.
Figure 8C:
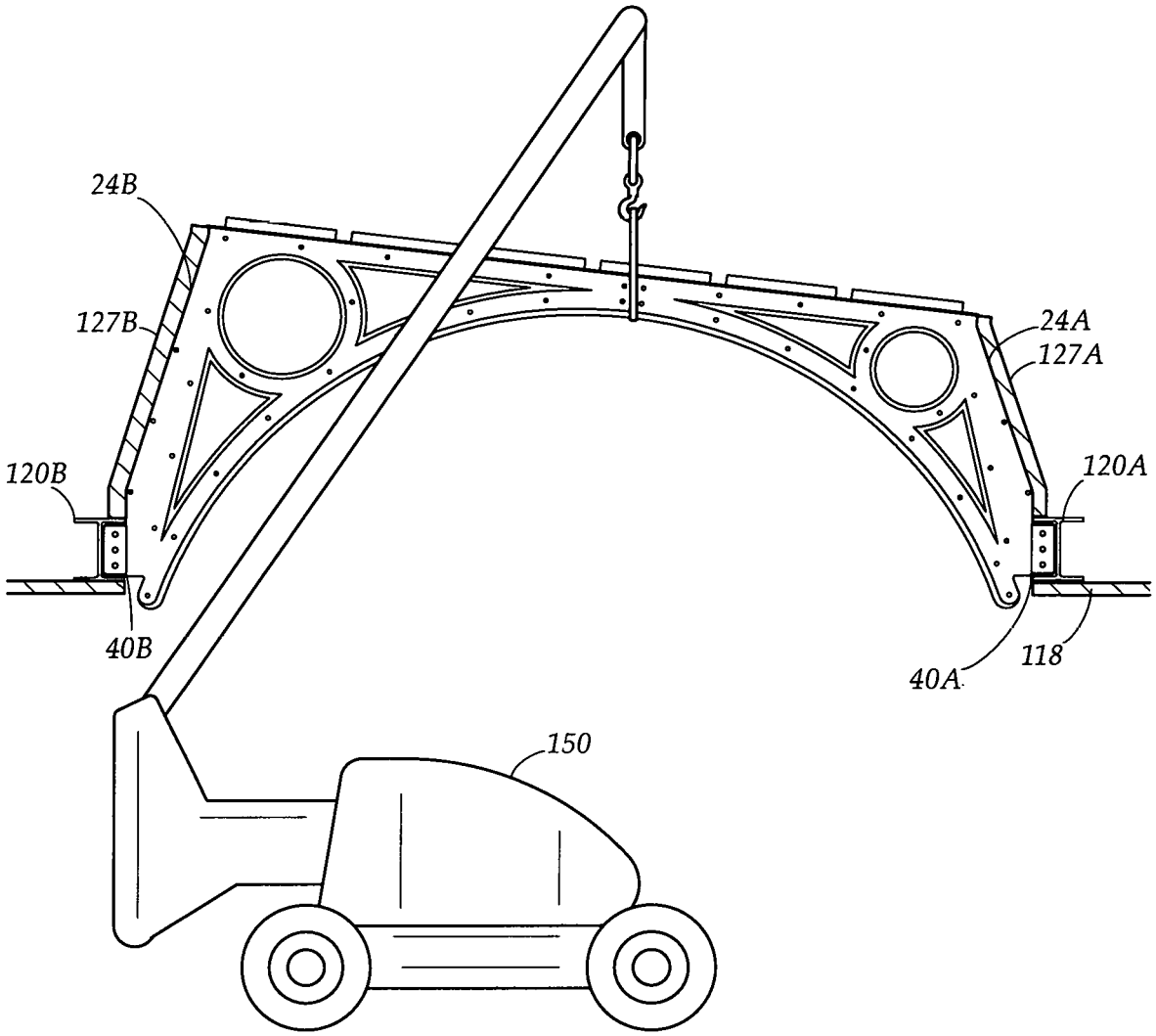
FIG. 8C is a diagrammatic side view of the laminated arch being secured within an anchoring structure, in accordance with an embodiment of the present disclosure.

Turning now to FIG. 8A-C, while simultaneously referring to FIGS. 1A-B, 2-3, and 7, in a preferred embodiment, the laminated structural arch system may be handled, assembled, and installed by two workers, using a portable hand-operated hoist 150. The workers first remove the arch plates 140 from the kit 130 and assemble each laminated arch 20. In one embodiment, the workers may assemble and secure the second outer arch plate 64 and the inner arch plate 44, before attaching the first outer arch plate first and second halves 55A, 55B to form the first outer arch plate 54 and complete the laminated arch 20, as shown in FIG. 8A. Next, the workers may attach the laminated arch 20 to the hoist 150, as shown in FIG. 8B. The hoist 150 is positioned beneath the anchoring structure 118, and the position of the laminated arch 20 may be adjusted so that the first anchoring plate 40A and the second anchoring plate 40B are aligned with the first and second beams 120A, 120B respectively. Once the laminated arch 20 is properly aligned beneath the anchoring structure 118, the workers may raise the laminated arch 20 using the hoist 150 so that the laminated arch 20 is positioned perpendicularly between the first and second beams 120A, 120B, as shown in FIG. 8C. While the laminated arch 20 is suspended in place by the hoist 150, the workers may then secure the first and second anchoring plates 40A, 40B to the first and second beams 120A, 120B respectively. The anchoring structure 118 may also have a first abutment surface 127A and a second vertical abutment surface 127A, such as a pair of opposing walls. The laminated arch first and second abutment surfaces 24A, 24B may also be secured to the first and second abutment surfaces 127A, 127B respectively. Once the laminated arch 20 is securely attached to the anchoring structure 118, the laminated arch 20 is detached from the hoist 150, and the hoist 150 may be lowered. These steps may be repealed until all of the laminated arches 20 are secured to the anchoring structure 118. The workers may then place the one or more panels 124 which form the horizontal planar structure across the one or more laminated arches 20 to complete the installation of the laminated structural arch system 10. Note that this example is non-limiting, and it will be apparent to a person of ordinary skill in the art in the field of the invention to vary the steps in accordance with the principles disclosed in the present disclosure.

It is understood that when an element is referred hereinabove as being "on" another element, it can be directly on the other element or intervening elements may be present there between. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a laminated structural arch system. The disclosure is illustrated by example in the drawing figures, and throughout the written description. It should be understood that numerous variations are possible, while adhering to the inventive concept. Such variations are contemplated as being a part of the present disclosure.

The invention claimed is:

1. A laminated structural arch system for supporting a horizontal planar structure, comprising:

at least one laminated arch;

wherein the at least one laminated arch is comprised of at least three thin arch plates rigidly fastened together with nuts and bolts, stacked in parallel;

wherein each arch plate is separated from the adjacent arch plate by a rigid spacer forming a separation gap;

wherein an interior arch plate of the stacked arch plates comprises a plurality of tabs; a horizontal support plate perpendicular to a top surface of the at least one laminated arch forming a cap; the support plate including slots receiving the tabs of the interior arch plate; the support plate configured to receive horizontal planar materials.

2. The laminated structural arch system of claim 1 comprising a plurality of laminated arches positioned in parallel and secured to an anchoring structure;

the plurality of laminated arches supporting the horizontal planar materials;

wherein the horizontal planar materials comprise one or more insulated or glass panels.

3. The laminated structural arch system of claim 1, wherein each structural laminated arch has a symmetrical shape or an asymmetrical shape.

4. The laminated structural arch system of claim 1, wherein Computer Assisted Drawing and Computer Numeric Control fabrication technologies are used for ease of mass production; the laminated structural arch system being cut by plasma, laser or water-jet, and fabricated from thin planar material of various types and gauges of metal or plywood.

* * * * *